United States Patent [19]

Jacobs

[11] Patent Number: 4,538,741

[45] Date of Patent: Sep. 3, 1985

[54] CONTAINER AND LID

[76] Inventor: Stanley A. Jacobs, P.O. Box 1979, New Haven, Conn. 06509

[21] Appl. No.: 547,907

[22] Filed: Nov. 2, 1983

Related U.S. Application Data

[63] Continuation-in-part of Ser. No. 379,746, May 19, 1982, abandoned.

[51] Int. Cl.[3] ..... B65D 41/18

[52] U.S. Cl. ..... 215/320; 220/306

[58] Field of Search ..... 215/320, 317; 220/306

[56] References Cited

U.S. PATENT DOCUMENTS

| | | | |
|---|---|---|---|
| 2,814,404 | 11/1957 | Towns | 215/320 |
| 3,325,044 | 6/1967 | McCutcheon | 220/306 |
| 4,279,358 | 7/1981 | Jacobs | 220/321 |

*Primary Examiner*—Donald F. Norton

*Attorney, Agent, or Firm*—Wolf, Greenfield & Sacks

[57] ABSTRACT

A one-piece tightly fitting, molded plastic lid intended to be used in association with a container having a laterally-protruding lip extending about the perimeter of its mouth. In each embodiment of the invention the plastic lid is provided with a surrounding depending sidewall having a relatively thin upper web segment which is adapted to deform heightwise to conform to the shape of the protruding container lip as the lid is fitted onto the container. The lower region of the lid sidewall has a resilient skirt which is thicker than the web segment and thus has a greater elastic memory. The sidewall skirt stretches when forced over the protruding lip and then the skirt retracts radially inwardly closely adjacent to the outside wall of the container immediately below the lip to stretch the deformable web segment tightly over the lip to seal the mouth of the container.

13 Claims, 13 Drawing Figures

CONTAINER AND LID

RELATED APPLICATIONS

This application is a continuation-in-part of my prior application Ser. No. 379,746 filed May 19, 1982 and entitled CONTAINER LID, now abandoned.

FIELD OF THE INVENTION

This invention relates generally to container closures and more particularly to one-piece tightly fitting, molded plastic lids for use with containers having a protruding lip around the periphery of the mouth.

BACKGROUND OF THE INVENTION

Containers with snap-fitting, removable lids often are formed with a mouth defined by a peripheral lip and a channel which together are intended to provide a suitable seal with an associated lid. In most such containers, the lid is applied to the container at the factory to create a satisfactory seal. However, the user often removes the lid with a prying tool, such as a screwdriver, especially if the lid is metal, and this action results in deformation of the container and/or the lid in a manner which may disrupt the formation of a cooperative seal when the lid is later replaced. Such deformation often makes it difficult or impossible to reseal satisfactorily the container utilizing the same lid. As a result, the contents of the container may deteriorate, either hardening or evaporating. Leakage of the contents from the container or leakage of water or other liquids into the container also can occur, either damaging the surface upon which the container is placed or rendering the contents unusable.

A lid which satisfactorily overcomes many of the problems attendant to poor resealing is described in my U.S. Pat. No. 4,279,358. The lid described in that patent has an inwardly-facing shoulder formed on its depending sidewall which engages the underside of the protruding lip on the container. That lid is particularly suited for use with certain size and shape container lips, and precise placement of the inwardly-facing shoulder is desirable for optimum seating of the lid.

SUMMARY OF THE INVENTION

One aspect of the invention relates to a configuration for snap-fitting, one-piece, molded plastic lids which are modifications of the lid described in my U.S. Pat. No. 4,279,358. Each lid configuration of this invention is adapted for use with a container having a laterally protruding peripheral lip, and is easily and inexpensively molded, easily removed and provides a tight and secure seal around the mouth of the container.

The lid includes a top wall and a sidewall which depends from the periphery of the top wall. The upper portion of the sidewall comprises a relatively thin, deformable web segment which is stretchable heightwise. The lower portion of the sidewall is contiguous with the upper portion and comprises a skirt having a greater radial thickness and greater elastic memory than the upper web portion.

The container preferably is molded and has a specially contoured rim extending about the container mouth. The rim includes an outer lip which extends radially outwardly away from the container sidewall. The outer lip is smoothly rounded along its outer upper sealing surface having a downwardly and outwardly sloping contour as it approaches the greatest diameter of the lip. The contour of the lip then extends inwardly toward the container sidewall at a sharper angle. The upper sealing surface of the lip cooperates with the stretchable web on the lid so that the web will wrap about the upper sealing surface to provide a seal.

In another aspect of the invention the container rim also may have an inner lip which extends radially inwardly from the inner surface of the container wall. The inner lip has a downwardly and inwardly sloping inner seating surface which cooperates with an inner sealing ring formed on the lid. In this embodiment of the invention the container rim is engaged both on the inside and the outside by the lid and in a manner which enhances the seal while also providing substantially increased hoop strength for the container and lid individually and in combination.

In one embodiment of the lid, the inner surface of the lid sidewall of the container is smooth and free of interruptions, such as shoulders, along its height. The inner diameter of the lid sidewall is smaller than the outside diameter of the container lip and generally equal to the outside diameter of the container. In another embodiment of the lid, the sidewall is provided with a shoulder which, when the lid is seated on the container, will be disposed below the outer lip of the container to provided added resistance to inadvertent removal.

In still another embodiment of the invention the lid may be provided with a compressible ring of sealing material which is carried by the lid and which will engage the uppermost edge of the rim when the lid is seated.

In each embodiment of the invention, when the lid is applied to the container, the inner surface of the sidewall is advanced over the lip. Once the lower, skirt portion of the sidewall has advanced past the lip, its elastic memory causes it to contract radially inwardly toward the container sidewall thereby stretching the thin upper web segment of the sidewall around the lip of the container drawing the web into conformity with the shape of the lip. The contracted lower portion of the sidewall thereafter remains immediately below the lip, tensioning the upper web segment of the sidewall in engagement with the lip. The elasticity of the lower skirt portion of the sidewall maintains the seal and prevents the sidewall and the cover from riding up over the container lip.

The lid may be provided with an inner sealing band or ring which depends from the top wall and is adapted to seat against the inner surface of the container opening by the stretching of the lid sidewall over the container lip. The sealing band is molded integrally with the lid and is spaced radially inwardly from the lid sidewall. The lid also may be provided with a plurality of reinforcing ribs extending radially inwardly from the sealing band.

The lid of this invention is reusable, without destroying its sealing capabilities, for the life of the elastic memory of the lower portion of the lid sidewall.

In the embodiment of the lid which has no internal shoulder, the smooth interior surface of the sidewall makes molding of the lid easy and fast and facilitates application and removal of the lid. In addition, precise dimensioning of the container lid to the lip is not required and greater tolerances are permitted in forming the lid since the lower portion of the sidewall is sufficiently flexible to allow it to seat about the lip even if the fit is not exact. Thus, with the shoulderless embodiment one lid may be used with a variety of container lips having different shapes, radial dimensions and formed of different materials.

In other embodiments of the lid, which utilize a shoulder on the inner surface of the lid sidewall, the cooperation between the lid and the container is such that the shoulder tends to become drawn upwardly into engagement with the underside of the outer lip of the container. Although the engagement of the shoulder with the underside of the lip does not itself provide the primary seal, it does lessen the chance of the cover becoming dislodged inadvertently. To that end, this embodiment of the lid incorporates a V-shaped inner ring which is spaced radially inwardly from the periphery of the lid. The outermost wall of the V-ring is spaced slightly from the stretchable web on the lid sidewall and cooperates with the web to define an annulus receptive to the container rim. The configuration of the outer wall of the V-ring and the web of the sidewall is such as to cause a pinching or squeezing of the upper rim of the container tending to bias the lid upwardly. The upward biasing applied to the lid tends to draw the shoulder of the lid sidewall into engagement with the underside of the container outer lip. In addition the V-ring on the lid also enhances the hoop strength and resistance to distortion of the lid when it is apart from the container as well as when it is on the container. Still another advantage of this embodiment is that the V-ring provides for some flexibility in the lid which enables the lid to dome and flex without disrupting the seal between the web and container lip.

In a modification of the invention the lid may be provided with a compressible resilient gasket in the annulus which receives the container rim. The gasket is located and dimensioned with respect to the lid and rim so that it is compressed partially by the upper edge of the rim when the lid is on the container, thereby providing a supplemental and hermetic seal in addition to the primary seal effected by the cooperation between the web segment of the sidewall and the container outer lip.

It is among the general objects of the invention to provide improved containers, lids and cooperative sealing arrangements therefor. More particularly, it is among the general objects of the invention to provide containers and lids of the type described which may be of integral molded plastic construction yet which display superior sealing and security characteristics.

Another object of the invention is to provide a sealing system for a lid and container in which the integrity of the seal is not destroyed by repeated reuse of the lid and container.

DESCRIPTION OF THE DRAWINGS

The objects, advantages and features of this invention will be more clearly appreciated from the following detailed description taken in conjunction with the accompanying drawing in which.

DETAILED DESCRIPTION OF THE PREFERRED EMBODIMENTS

Figure 1:
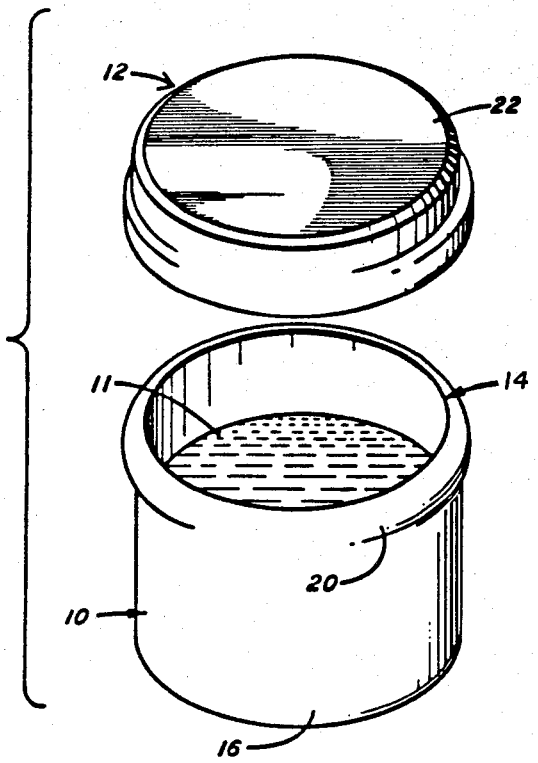
FIG. 1 is a pictorial representation of a container and lid in accordance with the invention.
Figure 2:
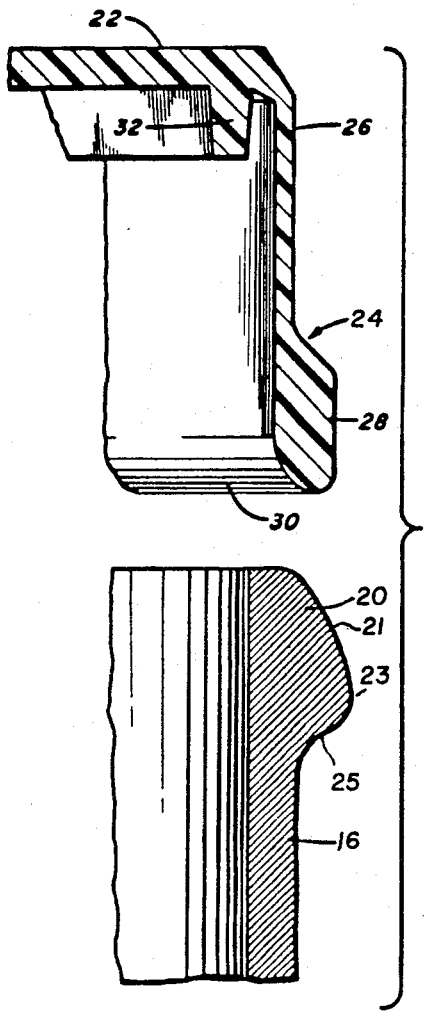
FIG. 2 is a partial sectional view of the container lid and container of FIG. 1 prior to application of the lid.
Figure 3:
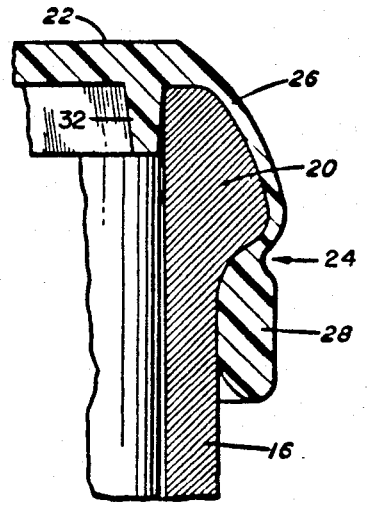
FIG. 3 is a partial sectional view of the lid and container of FIG. 2 after application of the lid to the container.

FIGS. 1–3 illustrate one embodiment of each of an exemplary container 10 and lid 12 incorporating an aspect of this invention. Container 10 typically has a generally cylindrical shape and the upper end of the container 10 is provided with a mouth 11 which extends generally across the entire diameter of the container. Mouth 11 is bounded by a rim 14 region at the upper end of container sidewall 16 which may be formed integrally with or formed as a separate piece and secured to the upper end of sidewall 16. A surface 18 is formed at the rim region 14 on the inwardly facing side of the sidewall 16 and outer lip 20 is disposed on the outwardly facing side of the rim region 14. Lip 20 projects radially outwardly away from sidewall 16 of the container and extends around the entire periphery of mouth 11. Lip 20 preferably is smoothly rounded along its entire outer surface and is formed to define an upper seal surface 21 which slopes downwardly away from the top of the rim 14 until the point of greatest radial extent is reached (indicated at 23 in FIG. 2) after which it curves more abruptly inwardly along a lower seal surface 25 toward sidewall 16. Lip 20 may be molded with sidewall 16 or formed separately and attached integrally thereto.

In each embodiment of the invention the lid 12 is molded as a unitary piece and includes a top wall 22 and a sidewall 24 which depends downwardly from the periphery of top wall 22. Sidewall 24 is formed of two segments, an upper web segment 26 adjacent top wall 22 and a lower segment or skirt 28 spaced from top wall 22. In the embodiment shown in FIGS. 1–3 the inner diameters of skirt 28 and web segment 26 are substantially equal so that the inner surface of sidewall 24 is smooth and uninterrupted. The inner diameter of sidewall 24 is generally equal to outside diameter of container sidewall 16 and is less than the outside diameter of lip 20. Web segment 26 is relatively thin and is deformable in a heightwise or axial direction. Skirt 28 is substantially thicker than web segment 26, is not deformable in a heightwise direction, and possesses a much greater elastic memory. Both skirt 28 and web segment 26 are expandable in a radial direction. The lower edge of skirt 28 may be bevelled or smoothly curved as indicated at 30 to facilitate the radial expansion of sidewall 24 as it is urged over the circumferential lip 20.

As shown in FIGS. 2 and 3, lid 12 is applied to container 10 by press-fitting it over rim 14. As the bevelled or smoothly curved lower edge 30 of lid sidewall 24 is urged downwardly against lip 20 of the container, the relatively thick skirt 28 is forced radially outwardly to expand as the lid is urged progressively downwardly onto the container. When skirt 28 has been advanced beneath lip 20, the elastic memory of the skirt 28 causes it to snap back to its original configuration and constrict radially inwardly about the container sidewall 16 until it seats against sidewall 16 beneath lip 20 as shown in FIG. 3. This elastic constricting force of skirt 28 causes web segment 26 to be stretched heightwise. When fully seated web segment 26 is in a thinner stretched configuration and is tightly and intimately wrapped about lip 20 causing web segment 26 to conform closely to the exterior shape of lip 20 to form a continuous seal. The heightwise stretching of web segment 26 over and around lip 20 by skirt 28 effectively inhibits lid 12 from rising upwardly and off container 10 and seals mouth 11.

As shown in FIGS. 2 and 3, lid 12 also may be provided with a sealing ring 32 which is usually molded integrally with the lid. Sealing ring 32 depends downwardly from the underside of top wall 22, is spaced radially inwardly from the outer perimeter of lid 12, and extends continuously around the lid parallel with the perimeter thereof. Sealing ring 32 is dimensioned so that it seats against surface 18 of container rim 14 when sidewall 24 is urged downwardly and stretched over lip 20. No channel is required in rim 14 for proper seating of ring 32, since the tight fit of sidewall 24 over lip 20 is sufficient to seat ring 32 against surface 18 and to seal mouth 11. The lack of such a channel prevents the accumulation of fluids between ring 32 and surface 18 which can prevent the formation of a good seal and permits all fluids to drip back into the container.

Figure 6:
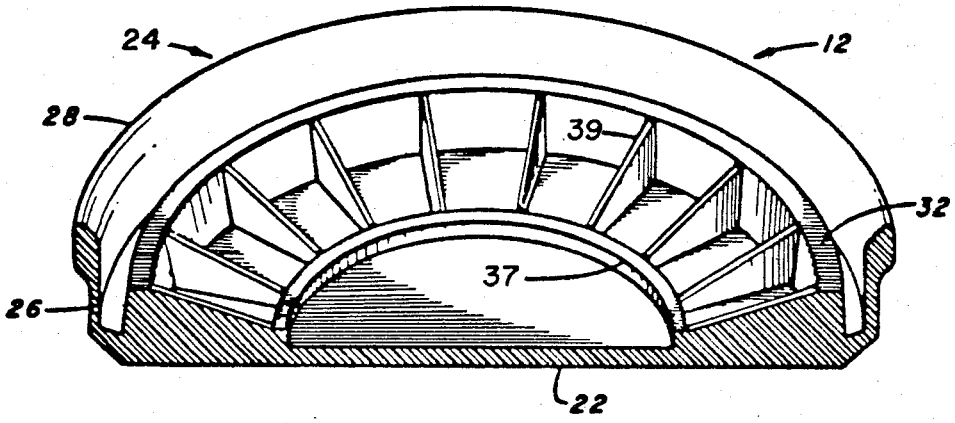
FIG. 6 is a cutaway pictorial representation of one embodiment of the lid of this invention.

In a modification of the foregoing embodiment shown in FIG. 6, lid 12 may be provided with a plurality of radially extending ribs 39 on the underside of top wall 22. Ribs 39 typically extend from sealing ring 32 inwardly to another ring 37 radially spaced from ring 32 and concentric therewith. Ribs 39 are equally spaced in a circumferential direction about rings 32 and 37 and preferably decrease gradually in thickness normal to top wall 22 moving from ring 32 to ring 37. Thus, the lower radially extending surface of each rib 39 rises upward toward top wall 22 going from ring 32 to ring 37 to provide each rib with a trapezoidal cross-sectional shape. Ribs 39 reinforce top wall 22 and prevent top wall 22 from being deformed radially inwardly or outwardly and they help preserve the seal between lid 12 and mouth 11. Ring 32 also prevents radial deformation of lid 12, thus providing a more secure seal, especially in impact situations, by maintaining the circular shape of lid 12. Ribs 39 maintain the flat configuration of top wall 22 and prevent it from warping, thus minimizing splaying of sidewall 24 and providing a secure seal. Ribs 39 and rings 32 and 37 are formed of the same material as the lid and add little extra weight thereto.

Figure 4:
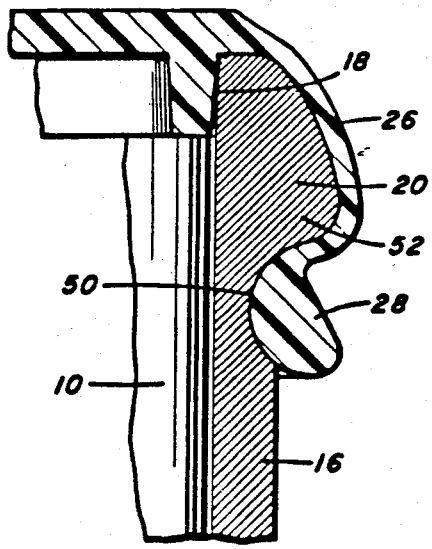
FIG. 4 shows an alternative embodiment of the container of FIGS. 1–3.
Figure 5:
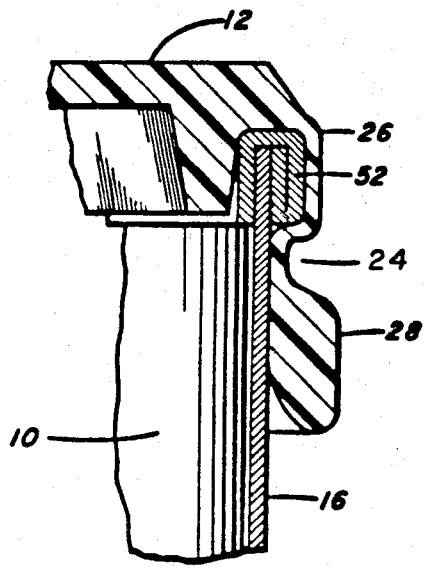
FIG. 5 shows an alternative embodiment of the container lip of the container of FIGS. 1–2.

Alternative embodiments of the container and lid configurations are shown in FIGS. 4 and 5. Since the containers and lids illustrated in FIGS. 4 and 5 are identical in some general respects to those of FIGS. 1–3, like numbers are used for like parts for convenience. In FIG. 4, exterior sidewall 16 of container 10 is provided with an indentation 50 formed immediately below lip 20. In this embodiment the inner diameter of skirt 28 is slightly less than that of the outside diameter of container sidewall 16, so that as skirt 28 is forced over lip 20, its elastic memory causes skirt 28 to retract sufficiently to reside within indentation 50. Indentation 50 conforms to the shape of the inner wall of skirt 28 in its seated condition, so that skirt 28 seats securely and tightly within indentation 50. This seating of skirt 28 within indentation 50 produces a greater heightwise stretching of web segment 26, thereby providing a tighter fit of lid 12 on container 10 and providing a more secure seal.

FIG. 5 illustrates the application of this invention to a container having a lip 52 similar in shape and dimension to that found on conventional metal, wide-mouth paint containers. Lip 52 is provided with a less rounded, more sharply angled, top and undersurface than lip 20 and is also provided with a lesser radial dimension with respect to the container sidewall. Typically, the radial dimension of lip 52 measured in its protrusion from container sidewall 16 is about one-half as great as that of the type of lip illustrated at 20 in FIGS. 1–4.

The lid and container of this invention have several advantages over the lid and container as described in U.S. Pat. No. 4,279,358. As to the lid, omission of the inwardly facing shoulder on the inner surface of sidewall 24, enables the foregoing embodiment of the lid to be molded more easily, faster and less expensively. As to the container, lip 20 has a much greater radial dimension which provides a much larger and better shaped surface over which web segment 26 may contact the lip 20. That causes a greater stretching force of web segment 26 with resulting greater surface area of the sidewall which wraps about the lip 20. The more rounded configuration of lip 20 allows web segment 26 to conform more closely to the shape of the lip. The rounded configuration of lip 20 also facilitates both the removal and the application of lid 12 to container 10. The greater extent of wrap of web segment 26 around lip 20 and the greater radial dimension of lip 20 also ensures that the lid will not inadvertently pop off the container. The greater chord length and greater stretching of web segment 26 allows the container to accommodate variations in web segment 26 or improper seating of ring 32 against surface 18 without breaking the seal between the container and the lid.

The absence of an inwardly facing shoulder facilitates application and removal of the lid from the container. The degree of curvature which may be imparted to the lip is in part a function of the degree of flexibility and elasticity of the material used for the lid. The softer or more flexible the lid material, the more it will bend and the sharper the curve formed by the lip may be and the greater its permissible radial extent. A stiffer material will require a more gentle slope or curve on the underside of the lip than a lip with a lesser radial extent.

The amount of stretch that may be imparted to the web segment and the amount of snap the skirt possesses as it is pushed over the lip during application of the lid is a function of the elastic memory of the skirt which in turn is proportional to the skirt thickness. It also is a function of the strength of the skirt relative to the web segment. If a greater elastic memory or a greater strength or a tighter seal is desired the skirt may be provided with a greater radial thickness. The seal may be improved further by providing the skirt with an inside diameter a few thousandths of an inch less than the outside diameter of sidewalls 16 of the container. In this manner, the skirt will snap back against the container sidewall more quickly and bear against the container sidewall with greater force, providing a tighter seal by more tightly stretching the web segment over the lip.

By way of example only, the dimensions of a container and lid described in the foregoing embodiments of this invention are set forth. It is to be understood, that by providing such examples, the scope of the invention is in no way limited. Thus, top wall 22 of lid 12 may have a thickness of 0b 0.05 inches; lip 20 extends radially outwardly a maximum distance of 0.145 inches from the inside wall of container 10; the radius of curvature of lip 20 at its maximum radial extent is 0.05 inches; lip 20 has an axial extent of about 0.25 inches; web segment 26 has a radial thickness of 0.015 inches; skirt 28 has a radial thickness of 0.06 inches or about one half the thickness of lip 20, and extends outwardly a distance of 0.045 inches from the exterior surface of web segment 26; skirt 28 has a heightwise dimension of approximately 0.125 inches; the entire heightwise dimension of the sidewall 24 is approximately 0.265 inches; and the heightwise dimension of web segment 26 alone is 0.14 inches.

Typically, the lid of this invention is formed of a low density polyethylene, although other suitably elastic materials may be used.

Container 10, although shown as being cylindrical, may be a cube, a parallelopiped or any other desired shape. Mouth 11 may be formed as shown or formed on an axially extending neck with a cross-sectional dimension less than that of container 10.

FIGS. 7–13 illustrate additional embodiments and modifications of lids and containers in accordance with the present invention. In the embodiment of the container shown in FIGS. 7–9 the rim region 14 of the container includes an inner lip 60 in addition to the outer lip 62. The inner lip projects radially inwardly from the container sidewall 64. The inner lip 60 has a downwardly and inwardly sloping surface 66 which serves as an inner seat in cooperation with a V-ring formed on the lid, as will be described. The lower region of the inner lip 60 may slope downwardly and outwardly, as indicated at 68, to merge smoothly with the inner surface of the container wall 64. The inner lip may extend downwardly along the container wall to a greater extent than does the outer lip 62. The inner lip 60 serves to add substantial hoop strength to the container, particularly when the container is held by a bail. Preferably the thickness of the rim is at least substantially equal to or greater than the thickness of the container sidewall. It also cooperates with the shape of the outer lip and the configuration of the lid in a manner which facilitates placement of the lid on the container.

The outer lip 62 has the upper seal surface 70 which, as shown, extends in a smooth curve from the upper edge 72 of the rim downwardly and radially outwardly. In the embodiment shown in FIGS. 7–9 the outer lip 62 terminates in a relatively flat, downwardly facing horizontal ledge 74.

Figure 7:
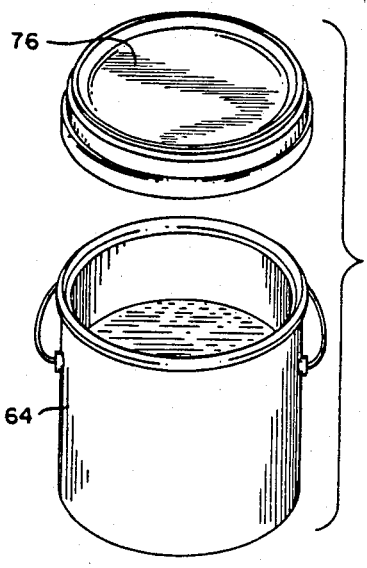
FIG. 7 is a pictorial representation of a container and lid in accordance with the modified embodiment of the invention.
Figure 8:
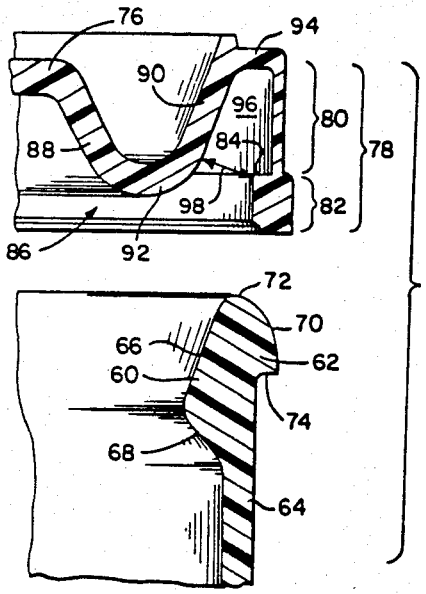
FIG. 8 is a partial sectional view of the container lid and container as shown in FIG. 7 prior to application of the lid and arranged to illustrate the relative diameters of the operative lid and container elements.
Figure 9:
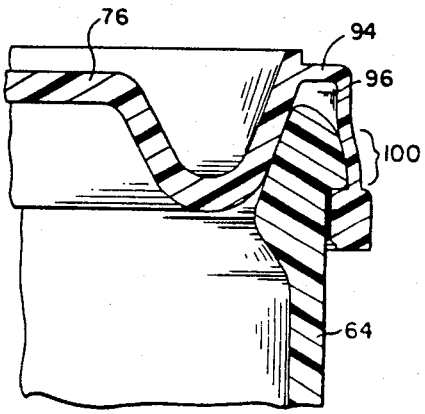
FIG. 9 is a partial sectional view of the lid and container of FIG. 8 after application of the lid to the container.

The lid illustrated in FIGS. 7–9 is of molded plastic construction and includes a top wall 76 and a surrounding sidewall 78 which extends downwardly from the top wall. As with the previously described embodiment, sidewall 78 includes two segments, an upper web segment 80 and a lower skirt segment 82. The skirt segment 82 is considerably thicker than the web segment 80 and has a greater elastic memory. The relatively thinner web segment 80 is more easily stretched and can be wrapped about the outer lip 62 of the container.

The embodiment of the lid shown in FIGS. 7–9 has a shoulder 84 formed at the inwardly facing surface of the sidewall 78. As shown, the shoulder 84 may define the transition between the web segment 80 and skirt segment 82. The shoulder 84 should be located along the sidewall 78 so that when the lid is pressed onto the container the shoulder 84 can be advanced downwardly about the outer lip 62 to a location below the underside of the outer lip, as defined by ledge 74. As will be described in further detail the shoulder 84 cooperates with the underside 74 of the outer lip 62 to provide an interlock and assure that the lid will not be dislodged inadvertently except when its removal is specifically intended. As described in connection with the previous embodiments the relative diameters of the outer lip 62 and web section 80 of the lid sidewall are such that when the web segment 80 is disposed about the outer lip 62 it will wrap about the outer lip in somewhat of a stretched configuration. Thus, the inner diameter of the web segment 80 is smaller than the outer diameter of the outer lip 62. Additionally the inner diameter defined by the skirt segment 82 of the lid is no greater than the outer diameter of the container sidewall and preferably may be slightly smaller to provide an enhanced constricting effect.

Figure 10:
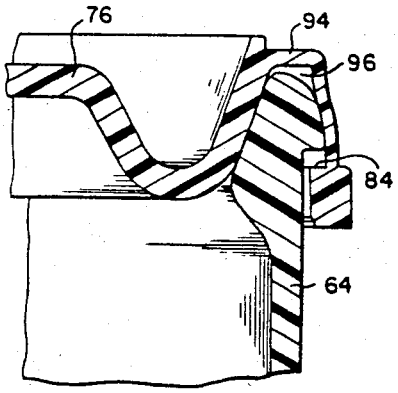
FIG. 10 is an illustration of the lid shown in FIG. 9 applied under full pressure to the container.

The lid also includes annular V-ring 86 which is formed integrally with top wall 76 of the lid and is located radially inwardly of the sidewall 78. The V-ring 86 includes an inner wall 88 which slopes downwardly and radially outwardly, and an outer wall 90 which slopes upwardly and outwardly. The V-ring outer wall 90 generally conforms to the slope of the inner seat 66 on the inner lip 60. The inner and outer walls 88, 90 are joined at a transition region 92 defined at a bight between the walls 88, 90. The upper end of the outer wall 90 merges into an annular connecting wall 94. As shown in FIG. 8 the sidewall 78 extends from the outer extremity of the connecting wall 94. Thus, the outer wall 90 of the V-ring 86, the connecting wall 94 and sidewall 78 define an annular channel 96 which is receptive to the rim of the container as illustrated in FIGS. 9 and 10 and as will be described. The annular channel 96 is generally tapered from a wider region at its lower end to a more narrow region at its upper end, at the connecting wall 94. The lower region of channel 96 defines a channel entry annulus indicated at the arrow 98 which defines the region through which the container lip enters into the channel 96. The entry annulus 98 extends between the outer surface of V-ring outer wall 90 and the closest point on the interior of the sidewall 78 which, as shown, is the inner surface of the shoulder region. In the preferred embodiment the entry annulus 98 is smaller than the corresponding radially measured thickness of the lipped container rim. When the lid is fitted onto the container the sidewall 78, including its web and skirt segments 80, 82, as well as the V-ring outer wall 90 flex so as to receive the lipped rim of the container. The lid components flex so as to enlarge the channel entry annulus 98. In this regard it should be noted that the generally upwardly tapering cross-sectional shape of the container rim, as defined by the inner lip 60 and/or outer lip 62 forms a generally wedge shape which facilitates progressive englargement of the channel entry annulus 98 and smoothly and temporarily distorting the V-ring outer wall 90 and sidewall 78.

FIG. 9 illustrates the lid and container of FIG. 8 in a seated, interlocked and sealed configuration. As illustrated, the web segment 80 has a significant portion which wraps about the outer lip in snug conformity and contact with a significant portion of the upper sealing surface 70. FIG. 9 illustrates the region of snug wrapping contact along a band indicated generally by the region 100. As described previously in connection with other embodiments of the invention, the constricting force of the skirt segment 82 secures the skirt 82 about the container sidewall, below the outer lip 62 to maintain the web segment 80 in its wrapped, sealed relation about the outer lip 62.

It should be noted that a high degree of effective sealing may be obtained without requiring full wrapping contact of the web segment about the full outer surface of the outer lip 62. By providing a band along which the seal is made, substantially greater seal surface contact is made than is the case with most containers which, at best, provide little more than a sealing line rather than a distinct band.

Among the further advantages of the invention is that the lid and container lip may be molded with a relatively wide range of tolerances without adversely affecting the quality and effectiveness of the seal. Thus, as can be seen from FIGS. 9 and 10 the annular channel 96 may be dimensioned to have a vertical height somewhat greater than the vertical height of the outer lip 62. When the lid is on the container, as shown in FIG. 9, the connecting wall 94 may be spaced somewhat from the upper edge 72 of the rim thereby leaving the uppermost region of annular channel 96 unoccupied. The additional unoccupied region of annular channel 96 provides for a certain amount of tolerance between the lid and container. When the lid is fitted onto the container the skirt and web segments will assume the configuration illustrated in FIG. 9 thus effecting the seal. By providing the additional vertical height to the annular channel 96 the precise location of the shoulder is less critical. This may be seen from FIG. 10 which illustrates the container and lid of FIG. 9 but with the lid pressed down more forcefully over the container rim. Although, as shown in FIG. 10, that causes the shoulder to separate somewhat from the bottom of the outer lip 62, the sealing band 100 still is maintained. Thus, the skirt continues to maintain its constricting effect which continues to cause the wrapped sealed configuration of the web about the outer lip. Thus, the foregoing configuration assures that an effective seal will be made and will not be disrupted even if the lid and container are subjected to rough handling.

It may be noted from FIG. 10 that the sealing band 100 has shifted somewhat from its relative location illustrated in FIG. 9. That results from a tendency of web segment 80 and V-ring outer wall 92 to be further wedged apart by the generally wedged shape of the container rim. In this regard it should be noted that the taper of the annular channel 96 preferably is somewhat less than the general wedge or taper defined by the rim of the container. As the parts are progressively mated the generally wider wedge defined by the rim will tend to spread apart the relatively narrower wedge defined by the annular channel 96. This has been found to tend to cause the sealing band 100 to shift positions more upwardly along the upper sealing surface 70. The seal is not disrupted or broken but, instead, is merely shifted thereby enabling the container and lid to be subjected to varying loads and a wide variety of conditions which, instead of breaking a seal, merely shift it to a different but continuous location.

It also should be noted that the relative sizes of the wedge on the container rim and the wedge defined by the annular channel also are such as to cause the lid and container to tend to assume the configuration shown in FIG. 9. Thus, even if the lid is forced down to the position shown in FIG. 10, when released the V-ring outer wall 90 will tend to re-expand somewhat and in cooperation with the web segment 80, will tend to pinch the wedge-like rim to tend to cause the lid to rise upwardly. That, in turn, tends to draw the lid to the configuration shown in FIG. 9 in which the shoulder is in proximity to or engaged with the ledge 74 thereby preventing further rise of the lid.

The V-ring, and particularly its outer wall 90, maintains contact with the inner seat 66 of the inner lip 60. Although that does provide an additional sealing region, the primary seal of the invention is effected along the band contact between the web segment and the outer lip. The cooperation between V-ring outer wall 90 and inner seat 66, however, serves to substantially increase the hoop strength of the combined container and lid. That is a particularly important advantage when the container is used in environments where rough handling may be expected, such as with paint cans.

Figure 11:
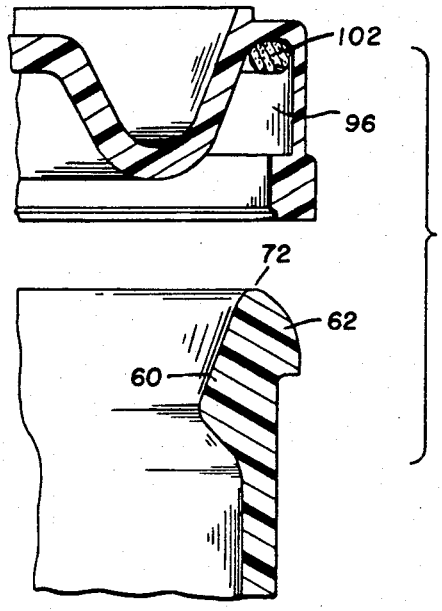
FIG. 11 is an illustration of the modified form of the lid incorporating a compressible gasket to effect a supplemental seal.
Figure 12:
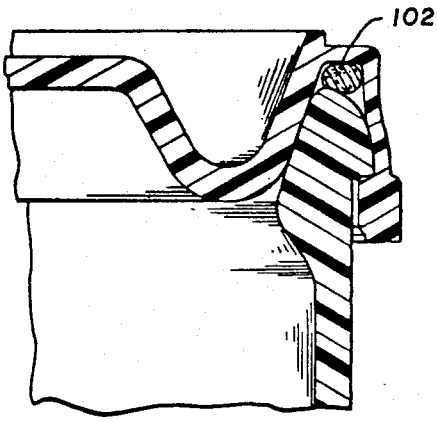
FIG. 12 is an illustration of the lid and container of FIG. 11 with the applying pressure relaxed and illustrating the retention of the supplemental seal.
Figure 13:
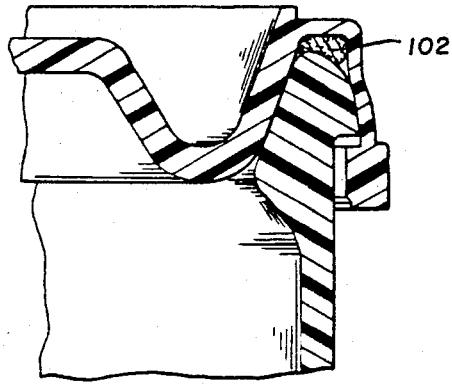
FIG. 13 is an illustration of the lid shown in FIG. 11 applied under full pressure to the container.

FIGS. 11–13 illustrate another modification to the invention in which a supplemental seal is included. In this embodiment a resilient compressible gasket 102 is located along the upper region of the annular channel 96. The gasket 102 may be formed from a foam plastic material which may be in the form of a foam plastic O-ring or which may be extruded directly into the upper region of the annular channel 96. The gasket 102, annular channel 96 and container rim are of a configuration such that when the lid is in its normal secured position on the container, such as the configuration shown in FIG. 9 and illustrated again in FIG. 12, the gasket 102 will be partially compressed against the upper edge 72 of the rim. As shown in FIG. 13, the gasket also should be compressible even further such as when the lid is forced down fully over the container, as described above in connection with FIG. 10.

Thus, I have defined my invention and its various aspects and embodiments. It should be understood, however, that the foregoing descriptions of the invention are intended merely to be illustrative thereof and that other embodiments and modifications may be apparent to those skilled in the art without departing from its spirit.

Having thus described the invention what I desire to claim and secure by letters patent is:

1. A lid for a container having a sidewall, a mouth disposed at the upper end of the sidewall, and a lip extending about the periphery of the container mouth, said lid comprising:

a top wall;

a relatively thin resilient sidewall web segment depending downwardly from said top wall and being stretchable heightwise and expandable radially; and a skirt integral with and extending from the lower edge of said web segment, said skirt being thicker than said web segment and displaying a greater resistance to radial and heightwise expansion and greater elastic memory than said web segment;

the inner diameter of said web segment being no more than the inner diameter of said skirt, the inner surfaces of said skirt and said web segment forming a continuous and uninterrupted inner sidewall surface;

said web segment being stretchable heightwise to enable it to wrap snugly and sealingly around the outer surface of said container lip when said lidis applied to said container, said skirt being constructed to retain the stretched web segment in sealing engagement-with said container lip when said lid is applied to said container mouth with said skirt against said container sidewall.

2. A lid as defined in claim 1 wherein the inner diameter of said skirt is substantially equal to the outer diameter of said container sidewall.

3. A lid as defined in claim 2 formed from low to medium density polyethylene, said web segment being of the order of 0.015 inches thick and said skirt of at least 0.06 inches thick.

4. A lid as defined in claim 1 wherein said lid further comprises a sealing ring molded integrally with and depending from the underside of said lid, said sealing ring being dimensioned to seat against an interior surface of said container mouth.

5. A lid as defined in claim 1 wherein said inner sidewall surface is a generally cylindrical surface.

6. A lid as defined in claim 5 wherein said inner sidewall surface is a right cylindrical surface.

7. Apparatus for sealing a wide mouth container with a lid comprising, in combination:

a container sidewall, the upper end thereof defining the boundary of said container mouth:

an outwardly protruding lip at the upper end of said container sidewall and extending around the entire perimeter of the container mouth;

said lid having a top wall and a lid sidewall secured to and depending downwardly from the periphery of said top wall of said lid, said lid sidewall having a smooth, shoulderless inner surface facing said container sidewall, said lid sidewall comprising:

a thin, elastic web segment stretchable in a heightwise direction; and a lower skirt portion formed integrally with and disposed below said web segment, said skirt having a thickness and resistance to heightwise and radial stretching greater than said web segment, said skirt having a lower portion adapted to be forced over said lip of said container;

said lid being adapted to be snap-fitted over said container mouth by forcing said sidewall over said lip of said container, to expand said skirt radially outwardly, said skirt being adapted to contract radially inwardly toward said container sidewall after passage over said lip to stretch said web segment heightwise and to deform said web segment to cause said web segment to closely conform to the shape of said lip and to wrap sealingly around the outer surface of said lip, said skirt being contracted below the lip to retain said web segment in sealing engagement with said container lip.

8. Apparatus as defined in claim 7 further comprising a depression disposed immediately below said container lip in said container sidewall for seating of said skirt therein.

9. Apparatus as defined in claim 7 wherein the underside of said lip facing away from the mouth of said container has a sharply angular cross-sectional profile.

10. Apparatus as defined in claim 7 wherein said lip is provided with a smoothly curved cross-sectional profile and slopes downwardly away from said container mouth, said lip extending outwardly away from said container sidewall a distance at least twice as great as the thickness of said skirt.

11. Apparatus as defined in claim 7 further comprising a sealing ring molded integrally with and depending from the underside of said lid, said sealing ring being adapted to seat against an interior surface of said container mouth when said lid is fitted onto said mouth of said container.

12. Apparatus as defined in claim 7 or 11 further comprising radially extending ribs formed on a bottom wall of said lid.

13. Apparatus as defined in claim 7 wherein the lower portion of the skirt is rounded.

* * * * *